US007874273B2

(12) United States Patent
Hertrich et al.

(10) Patent No.: US 7,874,273 B2
(45) Date of Patent: Jan. 25, 2011

(54) CAMSHAFT ADJUSTER AND METHOD FOR SETTING A LIMITING POSITION FOR A CAMSHAFT ADJUSTER

(75) Inventors: Steffen Hertrich, Nuremberg (DE); Lothar Schmitt, Eltmann (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 415 days.

(21) Appl. No.: 12/047,387

(22) Filed: Mar. 13, 2008

(65) Prior Publication Data

US 2008/0236528 A1 Oct. 2, 2008

(30) Foreign Application Priority Data

Mar. 29, 2007 (DE) ..... 10 2007 015 064

(51) Int. Cl.
*F01L 1/34* (2006.01)

(52) U.S. Cl. ..... 123/90.17; 123/90.15; 464/160

(58) Field of Classification Search ..... 123/90.15, 123/90.17, 90.16, 90.18; 464/1, 2, 160
See application file for complete search history.

(56) References Cited

FOREIGN PATENT DOCUMENTS

DE 19860418 6/2000

*Primary Examiner*—Ching Chang
(74) *Attorney, Agent, or Firm*—Volpe and Koenig, P.C.

(57) ABSTRACT

A camshaft adjuster (1), in which an adjustment of the camshaft adjuster is limited by a limiting element (11) is provided. The limiting element (11) is connected by an eccentric to the associated component (3), in particular, to an inner rotor. By use of an eccentric adjustment of the limiting element, the position of the limiting element in the peripheral direction can be adapted according to the production conditions within the tolerance range. In this way, the mounting of the camshaft adjuster is simplified and the achievable accuracy of the limiting position is improved.

9 Claims, 4 Drawing Sheets

CAMSHAFT ADJUSTER AND METHOD FOR SETTING A LIMITING POSITION FOR A CAMSHAFT ADJUSTER

BACKGROUND

The invention relates to a camshaft adjuster with a limiting element for limiting the relative motion between two components of the camshaft adjuster. The invention further relates to a method, by which a limiting position of two components can be set, which are moved relative to each other for changing an adjustable angle of a camshaft adjuster.

For modern internal combustion engines, which are used in motor vehicles, the ability to influence the control times, in particular the intake and exhaust times, of the internal combustion engine is desirable. For this purpose, camshaft adjusters are used, which are used for influencing the relative rotational angle position of a camshaft relative to a crankshaft of the internal combustion engine, by which the control times of the internal combustion engine can be influenced depending on operation. This is advantageous, for example, with respect to the shape of the performance pattern, the torque characteristics, the gas emissions values, the consumption, and/or the sound emissions of the internal combustion engine.

For camshaft adjusters, there are different structural forms, for example, camshaft adjusters with integrated gears, for example, a one-stage or multi-stage triple-shaft gear with uniform or non-uniform transmission ratios, a multi-link gear or coupled gear, a wobble-plate gear, an eccentric gear, a planetary gear, a shaft gear, disk cam mechanism, or combinations of the above gear types. A camshaft adjuster with a vane-cell construction or axial-piston construction represents an example, alternative structural form of a camshaft adjuster, in which an adjustment motion is generated by a hydraulic medium. Other possible structural forms are, in particular, those with pivoting vanes or segmented vanes.

All of the above constructions of a camshaft adjuster can be used in the scope of the present invention. An adjustment angle of the camshaft adjuster is here generated by a relative motion of two components of the camshaft moved relative to each other. While such a relative motion can definitely involve a translating or rotational movement, below reference is made, for example, to a rotating relative motion of components constructed as an outer rotor and an inner rotor, as used, in particular, for a camshaft adjuster in vane-cell construction.

One-sided limiting, determining the degree of freedom with or without play for the relative motion can be realized by a limiting element. Here, it can involve, for example, a peg, pin, projection, or the like, which is connected to one component and which is guided in a groove of the other component and which contacts a groove end of the other component for the desired limiting position. Here, a desired pre-setting of the limiting position is problematic due to considerations of the production tolerances for the components, the groove, and the position of the limiting element. To make matters worse, an additional locking element is to be used in the surroundings of the limiting position or in the limiting position itself. This locking element is to stop the camshaft adjuster with or without residual play, for example, by breaking the supply with a hydraulic medium, for example, during the time around the switching off or starting of the internal combustion engine, and/or for locking in an "advanced" or "retarded" operating position of the camshaft adjuster, especially in defined operating situations of the internal combustion engine.

In DE 198 60 418 A1, it became known that limiting the adjustment motion for a camshaft adjuster in vane-cell construction by stopping the vane on the limiting walls of the work chambers oriented in the radial direction is insufficient, especially when a camshaft adjuster with an essentially unchanged structural form is to be used for various internal combustion engines, in which different maximum and minimum adjustment angles and locking positions are desired. Accordingly, it was proposed to provide on one component a stop bolt or an alignment pin, which is fixed or loosely guided in a base borehole by a press fit or by a transition fit. Similarly, it was proposed to form the stop bolt and the base borehole with threading and to screw the stop bolt into the base borehole or also to fuse the stop bolt in the base borehole. In the other component, an angled limiting groove is provided, which can have different sizes for different uses of the camshaft adjuster, in particular, it can extend over different peripheral angles. In addition, a locking pin is provided, which extends through two aligned boreholes of the components, which, when the hydraulic medium pressure is beneath a threshold value is pressurized by a spring into a locking position, while for a hydraulic pressure above the previously mentioned threshold value, the locking pin is pushed out of one component and into the other component. For the case of using both a limiting element in the shape of a stop bolt in an angled limiting groove and also a locking pin, in addition to the previously mentioned tolerances, it also must be taken into account that a locking position lies in an exactly predetermined interval of the region predetermined by the stop bolt and the angled limiting groove. For example, locking must be performed for an end position, that is, for the contact of the stop bolt on the angled limiting groove, so that the end of the angled limiting groove, the position of the stop bolt, and the boreholes, in which the locking pin is guided, must be aligned exactly to each other.

The problems stated above can lead to the result that for a preassembled adjuster, the present sum tolerances must be measured during the assembly of the camshaft adjuster. A matching stop pin is then fitted according to the result. This requires a complicated method during the assembly with high investment, increased requirements on measurement technology and precision, increased tool costs, and assembly line output losses. However, even for such a complicated pairing, the realizable tolerance has a lower limit. Further reduction of the achievable tolerance bands can be achieved only by increasing the expense and possible extraction.

SUMMARY

The invention is based on the objective of providing a camshaft adjuster, in which the influence of production tolerances on an adjustment angle setting or limiting is reduced. Furthermore, the invention is based on the objective of providing an improved method for setting a limiting position between two components of a camshaft adjuster that move relative to each other.

The invention is based on the basic idea that a defined, fixed stop bolt must not be used without consideration of the actually produced dimensions within the given tolerance range. Instead, the invention proposes that a limiting element is used, which has at least one eccentric. The eccentric can be used in a targeted way to equalize some production tolerances. It is similarly conceivable that structurally equivalent camshaft adjusters are adapted to different internal combustion engines and different necessary limiting positions by use of the eccentric.

For the construction and use of the eccentric, there are different possibilities:

On one hand, the limiting element itself can have eccentric outer contours like a cam, so that for different angle positions of the limiting element with respect to the component, with which this is connected, different radial extents of the limiting element can come into effect. In the simplest case, such an eccentric can equalize tolerance for the length of a produced angled limiting groove—if the angled limiting groove is too long, then the eccentric of the limiting element is used, such that a wider region of the limiting element in the peripheral direction is in active connection with the stops of the angled limiting groove—and vice versa.

An eccentric in the sense of the invention for each component or each group of components is understood to be a contact surface of the limiting element that changes its distance from a rotational axis in steps or continuously by the component or a component rotating about the rotational axis. Possible example embodiments include but are not limited to:

- an eccentric shaft with two equivalent or different circular cross sections, whose centers are offset to the longitudinal axis parallel to each other,
- a multi-sided profile,
- a polygonal profile, or
- a bolt with cam disk.

According to a preferred construction of the invention, the limiting element is connected (alternatively or cumulatively) to the associated component via the eccentric. This means that, due to the connection via the eccentric, according to the rotation of the limiting element, the limiting element can be placed at different positions in the peripheral direction, for example, with a cylindrical stop surface. Such placement can be performed during the assembly according to the previous tolerance-dependent production. In contrast to the "pairing" of a limiting element mentioned above, for example, a stop bolt, a continuous, especially fine setting possibility, which allows an arbitrarily exact positioning, is given by use of the eccentric. As another advantage, deviating from the complicated method mentioned above with exact measurement and subsequent pairing, only an angle-sensitive assembly of the limiting element with the associated component is required.

In a preferred construction of the invention, the limiting element connected to the component via the eccentric has a stop, which can involve, for example, a cylindrical outer surface projecting into an angled limiting groove. The limiting element is connected rigidly to the associated component. For setting a limiting position, the stop, for example, the cylindrical outer surface, comes in contact with a counter surface of the other component, which can involve, for example, the end of an angled limiting groove.

According to an alternative construction of the invention, it can be provided that the limiting element has a first and a second longitudinal section, wherein the second longitudinal section is essentially rotationally symmetric with respect to its longitudinal axis and the first longitudinal section is arranged on an axial end of the second longitudinal section and has an eccentric with respect to the longitudinal axis of the second longitudinal section.

Here, it can be provided that the second longitudinal section is held at least partially in one of the components moved relative to each other and the first longitudinal section engages in a connecting member formed on the other component.

For a rigid connection between the limiting element and the associated component, various connection possibilities are conceivable. For a desired fused connection between the limiting element and component, the limiting element must be aligned in an angle-exact position before creating the fused section and under some circumstances must be pre-fixed. Under some circumstances, a screwed connection between the limiting element and component is also possible, wherein this rigid screwed connection must be possible for different angled alignments. It is similarly conceivable to use a press fit for the connection between the component and limiting element, if this press fit becomes effective in the desired angled position. According to a special construction of the invention, at first there is a loose fit, a transition fit, or a loose press fit between the limiting element and the component, which also permits the pivoting of the eccentric. In the desired angled alignment of the limiting element, stamping is then performed, by which the fixed connection is created or completed.

Another aspect of the invention provides a method for setting a limiting position between two components moved relative to each other for changing an adjustment angle of a camshaft adjuster. In this method, first the components are brought into a desired limiting position. For this purpose, an adjustment aid is used, which can be tool, alignment bolt, or the like constructed selectively for this purpose. The limiting element is connected to one of the components via an eccentric. In the desired limiting position, which is secured by the adjustment aid, the limiting element is rotated, so that with the rotation, preferably the position of a stop in the peripheral direction approaches one end of the angled limiting groove. The rotation is constructed in such a way that at the end of the rotation, the limiting element is located at a pre-defined distance from a counter surface of the other component. For example, the rotation can be ended when a cylindrical stop face of the limiting element contacts a counter face of the other component, which, in this case, can be constructed as the end of an angled limiting groove.

According to an improvement of the method according to the invention, after the rotation of the limiting element, the degree of freedom for rotation of the limiting element is eliminated, so that the limiting element remains permanently in the selected angle position. As mentioned before, eliminating the degree of freedom can be realized through arbitrary fastening measures, for example, by stamping or caulking.

According to another aspect of the invention, the adjustment aid involves a stepped pin, which is inserted into a recess for a locking element. Through the shape of the diameter of the stepped pin, a desired play can be given, which is present in the operation of the camshaft adjuster between the angle position given by the limiting element and the angle positions, in which a locking element can become effective. Here, diameters can definitely be used, which deviate from the diameter of the locking pin inserted later.

Advantageous improvements of the invention emerge from the claims, the description, and the drawings. The advantages of features and of combinations of several features named in the description introduction are merely examples, without these absolutely having to be achieved by embodiments according to the invention. Additional features are to be taken from the drawings—in particular, the illustrated geometries and the relative dimensions of several components with respect to each other and also their relative arrangement and effective connection. The combination of features of different embodiments of the invention or of specific features of the invention is similarly possible deviating from the selected references of the claims and is herewith suggested. This also relates to features shown in separate drawings or named in their description. These features can also be combined with features of different claims. Likewise, features listed in the claims can be left out for other embodiments of the invention.

BRIEF DESCRIPTION OF THE DRAWINGS

Additional features of the invention emerge from the following description and the associated drawings, in which embodiments of the invention are shown schematically.

DETAILED DESCRIPTION OF THE PREFERRED EMBODIMENTS

Figure 1:
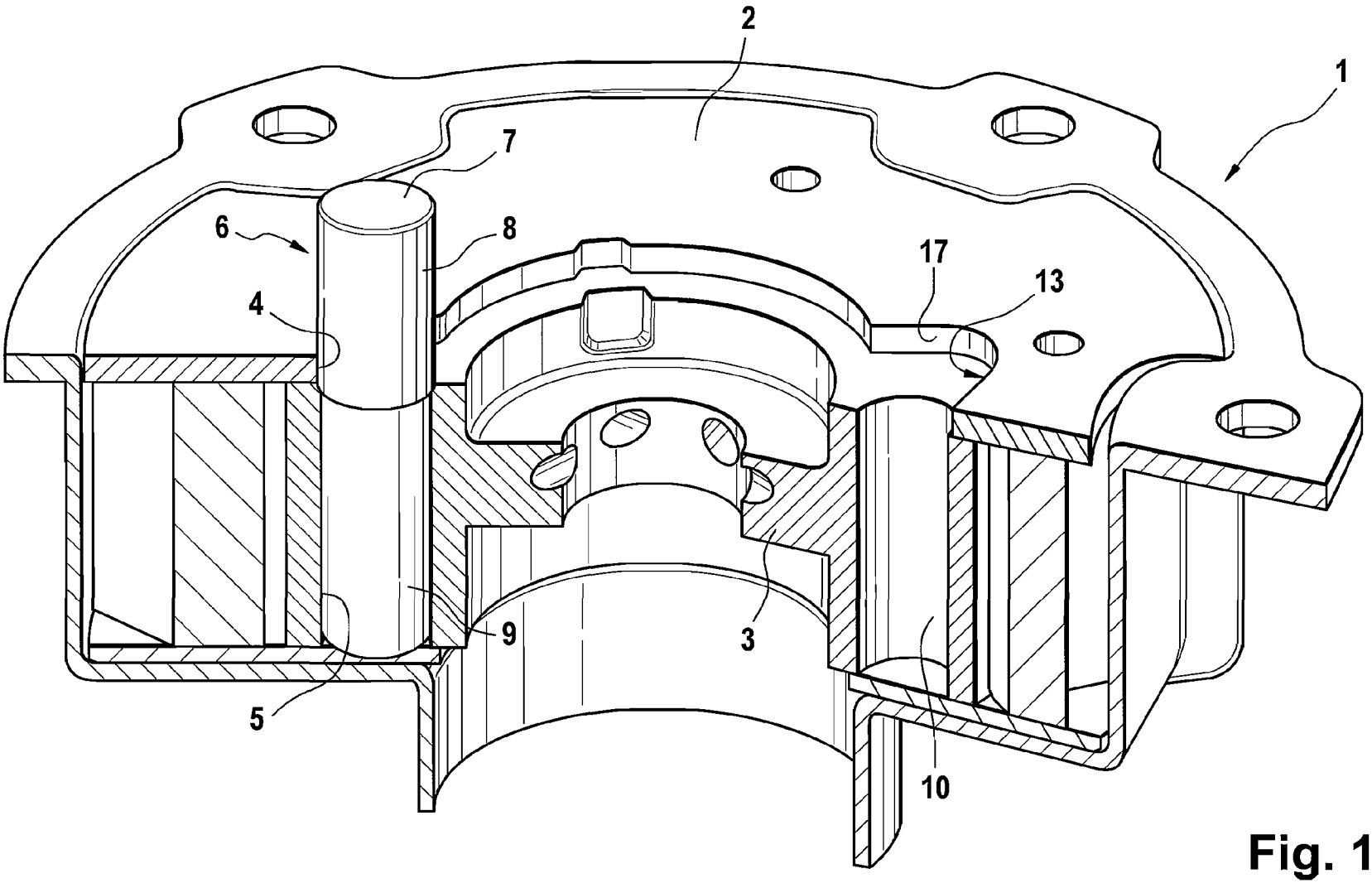
FIG. 1 shows a partially sectioned camshaft adjuster in a three-dimensional view, wherein a stepped pin is inserted into a borehole for a locking element before the assembly of the limiting element.

The invention is used for a camshaft adjuster 1 of arbitrary construction, in which a change of the adjustment angle of the camshaft adjuster 1 is associated with the relative motion of two components 2, 3. Such a relative motion can involve a translating and/or rotating motion. In FIGS. 1 to 4, reference can be made, for example, to a camshaft adjuster with a vane-cell construction, without this representing a limitation of the field of use of the present invention. The basic functional principle of a camshaft adjuster 1 with a vane-cell construction is described in a number of publications by the applicant, for example, DE 198 60 418 A1, which is incorporated herein as if fully set forth.

In a camshaft adjuster 1 with a vane-cell construction, an outer rotor is driven by a crankshaft of the internal combustion engine, for example, by a traction element, such as a chain. An inner rotor, which is locked in rotation with a camshaft allocated to the camshaft adjuster, can rotate about aligned rotational axis relative to the outer rotor. Work chambers, through which vanes of the inner rotor extend in the radial direction, are formed between the outer rotor and inner rotor. On the ends, these vanes contact an inner casing surface of the outer rotor with sealing. The vanes divide the work chambers into opposing and counteracting sub-work chambers, which can be charged selectively with a hydraulic medium for bringing about the desired adjustment motion. For the embodiment shown in FIGS. 1 to 4, the component 2 involves the outer rotor, while the component 3 forms the inner rotor of the camshaft adjuster 1 with a vane-cell construction.

The components 2, 3 have boreholes 4, 5, which are oriented parallel to the rotational axis and through which a locking pin 20 extends in the mounted state of the camshaft adjuster 1. During the mounting of the camshaft adjuster, an adjustment aid 6 is inserted into the boreholes 4, 5 in a first mounting step shown in FIG. 1, wherein this adjustment aid involves a stepped pin 7 in the shown embodiment. The stepped pin 7 has a first diameter region 8, in the region of which the borehole 4 of the component 2 also extends, as well as a second diameter region 9 in the region of the second component 3 in the mounted position sketched in FIG. 1. Through the adjustment aid 6 in the form of the stepped pin 7, the relative angle position between the component 2 and the component 3 is set without play or with a small, tolerable play.

Figure 2:
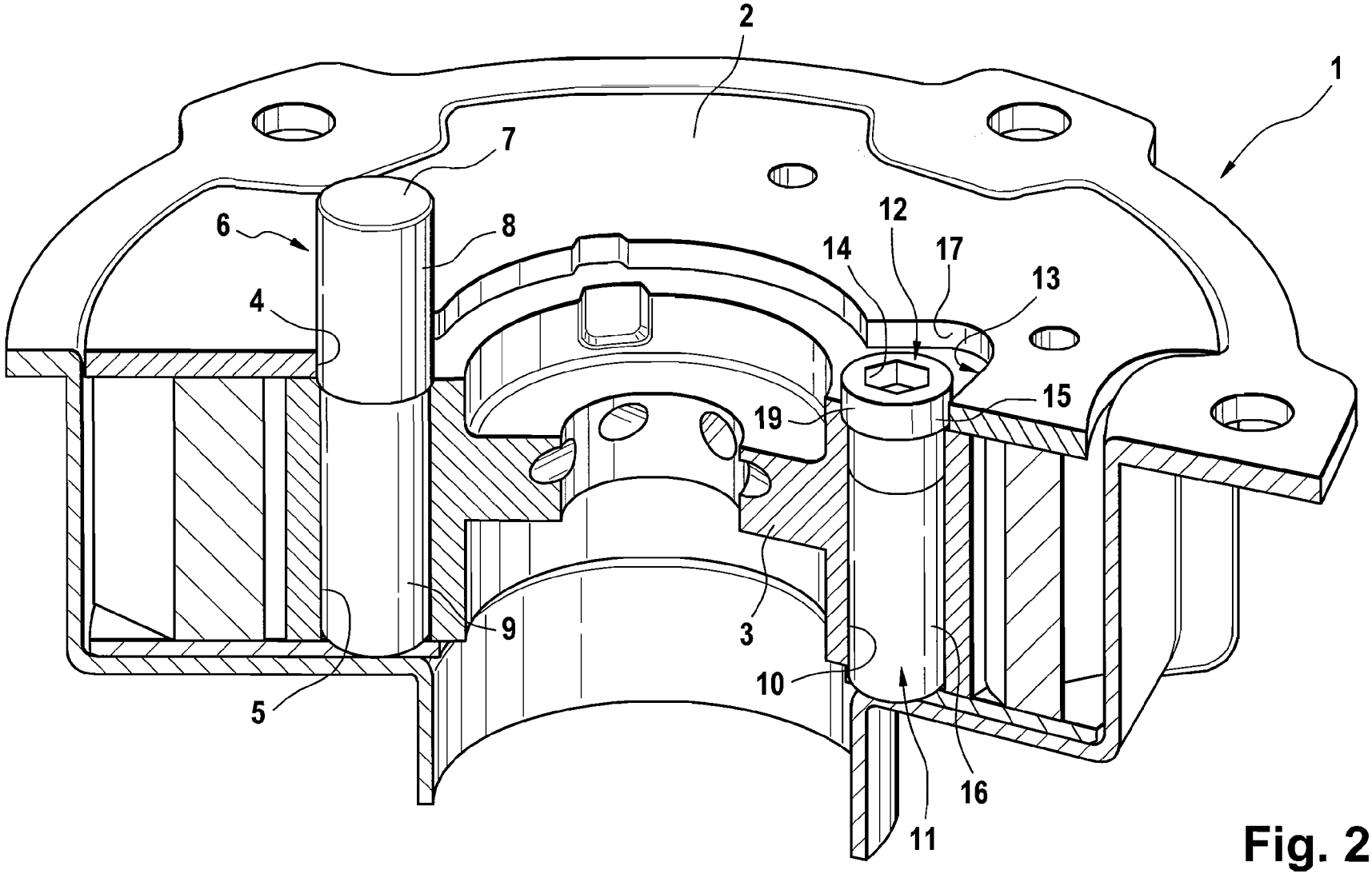
FIG. 2 shows the camshaft adjuster according to FIG. 1 in corresponding a three-dimensional view, wherein a limiting element is mounted with the camshaft adjuster.

In a subsequent processing step shown in FIG. 2, a limiting element 11 is inserted into a borehole 10, which, for example, lies diametrically opposite the boreholes 4, 5 or can be arranged at any peripheral angle. The limiting element 11 has a first longitudinal section 12, which is constructed in the shown embodiment as a head. The first longitudinal section 12 extends in the region of a connecting element 13, for example, a recess or peripheral groove or angled limiting groove. The first longitudinal section 12 has an engagement surface 14 for a tool, here a hexagonal bolt, on the end. The first longitudinal section 12 provides a cylindrical outer surface 15.

In addition to the first longitudinal section 12, the limiting element 11 has a second longitudinal section 16, which is constructed for the shown embodiment as a fitting section with cylindrical outer surface and which extends through the borehole 10 in the mounted position sketched in FIG. 2. The longitudinal axes of the longitudinal sections 12, 16 are oriented parallel to each other, but offset by an eccentricity E relative to each other. The eccentricity E can equal, for example, 10 to 50 μm, 50 to 100 μm, 100 to 200 μm, 200 to 500 μm, or 500 to 1500 μm. The eccentricity results in that, for a rotation of the second longitudinal section 16 in the borehole 10, caused by an actuation of the contact surface 14 by a suitable tool, the first longitudinal section 12 rotates with the eccentric about the longitudinal axis of the second longitudinal section 16.

Figure 3:
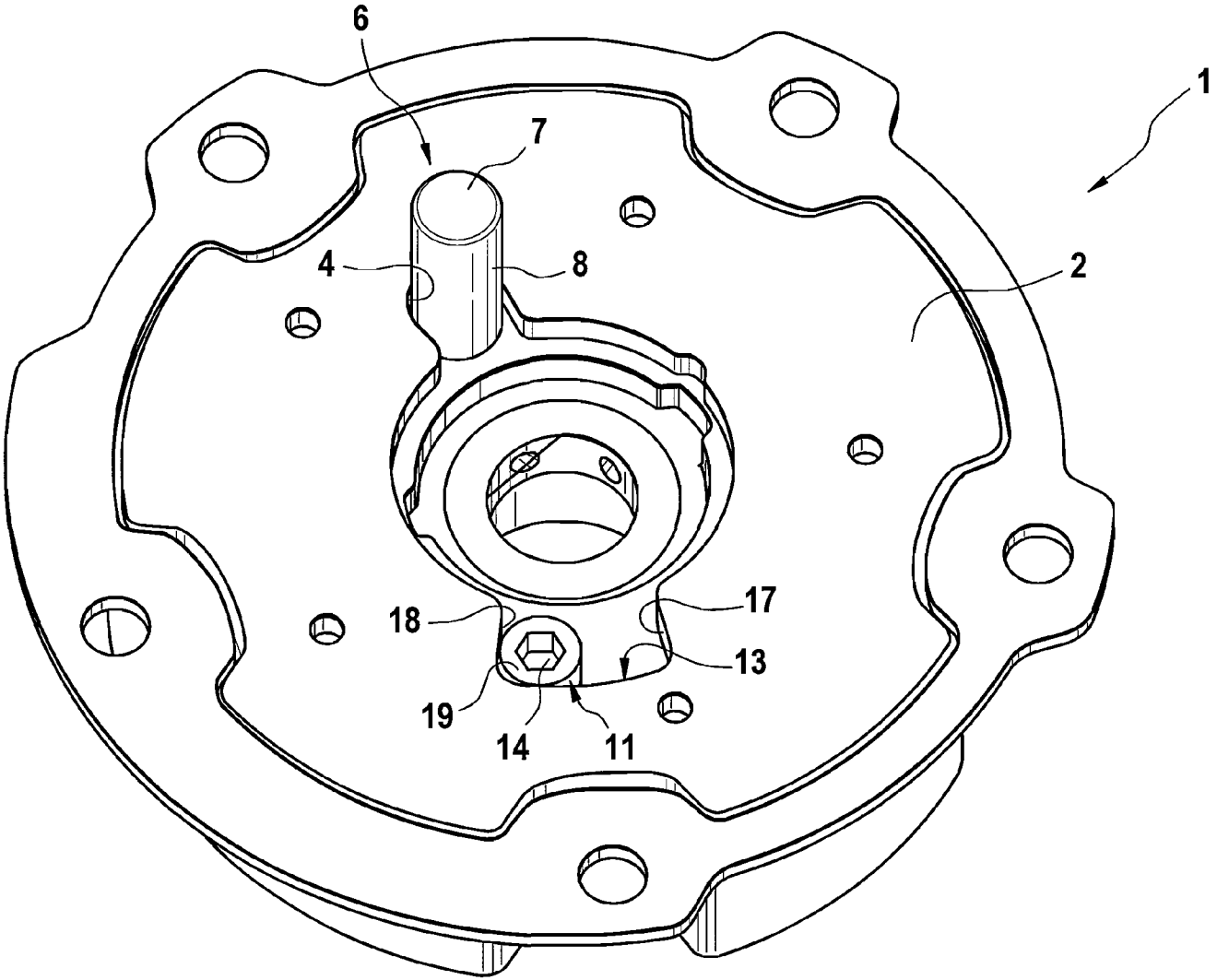
FIG. 3 shows the camshaft adjuster according to FIG. 2 in a modified three-dimensional view.

The connecting element 13 has end counter faces 17, 18, which are seen in FIG. 3. By use of the eccentricity, a rotation of the limiting element 11 leads to a maximum displacement of the outer surface 15 for rotation by 180° by twice the eccentric. With such rotation, the outer surface 15 comes into contact with the counter face 18, so that the part of the outer surface 15 facing the counter face 18 forms a stop 19 of the limiting element 11 in the first longitudinal section 12. For this purpose, the eccentricity is selected in such a way that possible tolerances in the production of the involved components of the camshaft adjuster 1 can be equalized by the rotation of the limiting element 11. Preferably, the eccentricity E corresponds to at least half the maximum expected production deviation. The rotation of the limiting element 11 can end when a given distance 19 and counter face 18 has been reached, for example, through measurement by corresponding sensors or for bringing about a contact of the stop 19 on the counter face 18. Likewise, it is possible that the torque is monitored for rotation of the limiting element 11, so that it can be provided that between the stop 19 and counter face 18 a given contact force is produced.

Then, in another processing step, the limiting element 11 is fixed relative to the component 3. For this purpose, caulking or stamping of the limiting element 11 can be performed in the borehole 10, wherein knurling or similar positive locking on the shaft of the limiting element 11 can also bring about and guarantee the rotational locking in the component 3.

If the limiting element 11 is fixed relative to the component 3, then in a subsequent processing step, the adjustment aid 6, here the stepped pin 7, is removed from the boreholes 4, 5.

Figure 4:
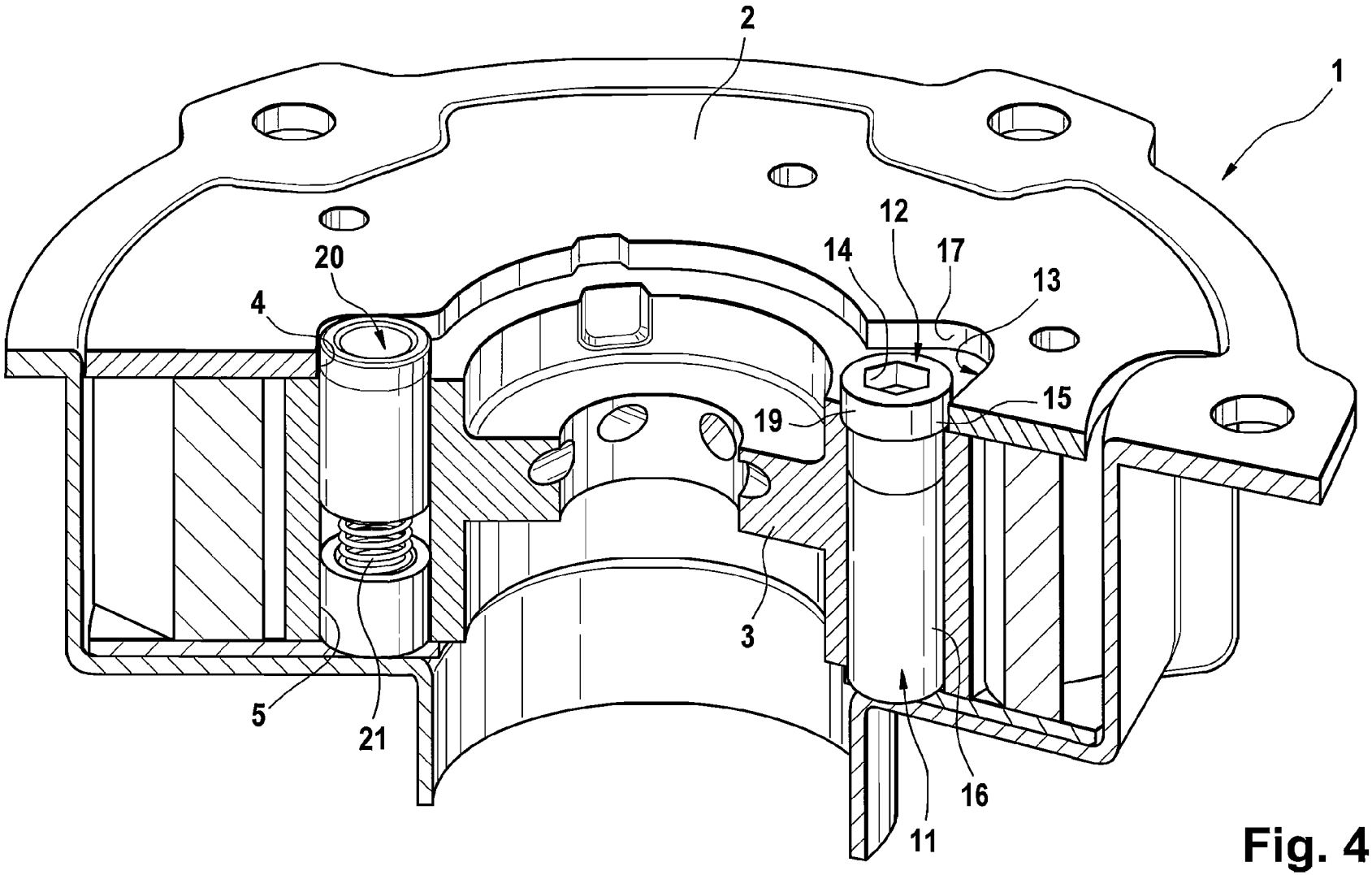
FIG. 4 shows a camshaft adjuster in a partially sectioned, three-dimensional view corresponding to FIGS. 1 and 2, wherein the adjustment aid in the form of the stepped pin is eliminated and a locking element is arranged in the borehole provided for this element.

Then, according to FIG. 4, a known locking pin 20 is inserted into the boreholes 4, 5, wherein this locking pin is supported in a known way by a spring 21 and which can be moved from the locking position shown in FIG. 4 during operation of the camshaft adjuster 1 in a known way by pressurization with a hydraulic pressure.

Through the selection of the diameter of the stepped pin 7 in the diameter region 9, it can be guaranteed on one hand that the stepped pin 7 is held fixed in the borehole 5. The diameter of the diameter region 8 is suitably dimensioned, in order to be held exactly in the borehole 4 of the component 2, so that the assembled position according to FIGS. 1 to 3 is given without play or with a defined amount of play. Here, the diameters of the diameter regions 8, 9 can definitely be greater than the diameter of the locking pin 20, when it is desired, during operation of the camshaft adjuster 1, that there is defined play, which correlates with the difference of the diameter of the diameter regions 8, 9 and the diameter of the locking pin 20, between the locking pin 20 and the boreholes 4, 5. Instead of the borehole 4, a radial bulge can be provided, in which the diameter region 8 of the stepped pin 7 is held without play. For the embodiment shown, the limiting element 11 is connected rigidly to the component 3. In the kinematic inverse, it is obviously also possible that the limiting element 11 is connected rigidly to the component 2 and moves between two counter faces 17, 18 of the component 3 for limiting a maximum adjustment angle.

LIST OF REFERENCE SYMBOLS

1 Camshaft adjuster
2 Component
3 Component
4 Borehole
5 Borehole
6 Adjustment aid
7 Stepped pin
8 Diameter region
9 Diameter region
10 Borehole
11 Limiting element
12 First longitudinal section
13 Connecting element
14 Engagement surface
15 Outer surface
16 Second longitudinal section
17 Counter face
18 Counter face
19 Stop
20 Locking pin
21 Spring

The invention claimed is:

1. A camshaft adjuster comprising a) two components that are movable relative to each other for changing an adjustment angle of the camshaft adjuster and b) a limiting element, by which a limitation acting in an adjustment direction of the camshaft adjuster for the relative motion between the two components can be brought about, and c) the limiting element has an eccentric.

2. The camshaft adjuster according to claim 1, wherein the limiting element is constructed with a stop, is connected rigidly to one of the two components, and for setting a limiting position the limiting element comes into contact on one side with a stop on a counter face of the other of the two components.

3. The camshaft adjuster according to claim 2, wherein there is a caulked or stamped fixed connection between the limiting element and one of the two components.

4. The camshaft adjuster according to claim 1, wherein the limiting element has a first longitudinal section and a second longitudinal section, wherein the second longitudinal section is constructed essentially rotationally symmetric with respect to a longitudinal axis thereof and the first longitudinal section is arranged on an axial end of the second longitudinal section and has an eccentricity with respect to the longitudinal axis of the second longitudinal section.

5. The camshaft adjuster according to claim 4, wherein the second longitudinal section is held at least partially in one of the components that are movable relative to each other and the first longitudinal section engages in a connecting element formed on the other of the two components.

6. A method for setting a limiting position between two components that are movable relative to each other for changing an adjustment angle of a camshaft adjuster, comprising:

a) setting a desired limiting position by an adjustment aid, b) connecting a limiting element, which has an eccentric, to a component, and adjusting the eccentric until the limiting element is located at a predefined distance from a counter face of the other component or comes into contact with the counter face.

7. The method according to claim 6, wherein subsequent to a rotation of the limiting element, eliminating a degree of freedom for rotation of the limiting element.

8. The method according to claim 6, wherein the adjustment aid is a stepped pin, which is introduced into a recess for a locking element.

9. The method according to claim 8, further comprising setting a play between the limiting element and the counter face or between the locking element and the recess by a diameter of the stepped pin.

* * * * *